US005767630A

United States Patent [19]

Williams

[11] Patent Number: 5,767,630

[45] Date of Patent: Jun. 16, 1998

[54] METHODS AND APPARATUS FOR OBTAINING FLOATING OUTPUT DRIVE TO FLUORESCENT LAMPS AND MINIMIZING INSTALLATION REQUIREMENTS

[75] Inventor: James M. Williams, Palo Alto, Calif.

[73] Assignee: Linear Technology Corporation, Milpitas, Calif.

[21] Appl. No.: 715,428

[22] Filed: Sep. 18, 1996

[51] Int. Cl.[6] ..... H05B 41/16

[52] U.S. Cl. ..... 315/282; 315/224; 315/307; 315/306; 315/DIG. 7

[58] Field of Search ..... 315/224, 307, 315/219, 221, 276, 278, 279, 282, 306, DIG. 5, DIG. 7

[56] References Cited

U.S. PATENT DOCUMENTS

| | | | |
|---|---|---|---|
| 4,277,728 | 7/1981 | Stevens | 315/307 |
| 4,344,122 | 8/1982 | Jones | 363/23 |
| 4,353,009 | 10/1982 | Knoll | 315/220 |
| 4,723,098 | 2/1988 | Grubbs | 315/306 |
| 4,905,136 | 2/1990 | Tanaka | 363/124 |
| 4,920,302 | 4/1990 | Konopka | 315/307 |
| 4,952,849 | 8/1990 | Fellows et al. | 315/307 |
| 5,001,386 | 3/1991 | Sullivan et al. | 315/219 |
| 5,068,576 | 11/1991 | Hu et al. | 315/291 |
| 5,111,118 | 5/1992 | Fellows et al. | 315/307 |
| 5,192,896 | 3/1993 | Qin | 315/224 |
| 5,402,043 | 3/1995 | Nilssen | 315/307 |
| 5,408,162 | 4/1995 | Williams | 315/224 |
| 5,519,289 | 5/1996 | Katyl et al. | 315/224 |
| 5,548,189 | 8/1996 | Williams | 315/224 |

OTHER PUBLICATIONS

"*RCA Designer's Handbook: Solid-State Power Circuits,*" Technical Series SP-52, pp. 300-338 and 409-429, published by RCA Corporation, Somerville, New Jersey in 1971.

"*1992 Catalog of Sumida Electric Co., Ltd.,*" pp. 1-5 and 25, published by Sumida Electric Co., Ltd., Japan in 1991.

"*Linear Technology Application Note 45,*" pp. AN45-1, AN45-21 to AN45-22, published by Linear Technology Corporation, Milpitas CA in Jun. 1991.

"*Linear Technology Application Note 49,*" pp. AN49-1 to AN49-16, published by Linear Technology Corporation, Milpitas CA in Aug. 1992.

Williams, Jim, "*Designing supplies for powering LCD backlighting,*" published in *EDN*, pp. 125-130, 132, 134 and 136, Oct. 29, 1992.

"*Linear Technology Application Note 55,*" pp. 1-43, published by Linear Technology Corporation, Milpitas CA in Aug. 1993.

Williams, Jim, "LCD-Hinterleuchtung mit hohem Wirkungsgrad," *Elektronik*, vol. 42, No. 4, pp. pp 82-84, Feb. 23, 1993.

Williams, Jim, "*Techniques illuminates backlit LCDs with high efficiency,*" published in *EDN*, pp. 89, 90 and 94, Jan. 6, 1994.

*Primary Examiner*—Robert Pascal
*Assistant Examiner*—Haissa Philogene
*Attorney, Agent, or Firm*—Fish & Neave; Mark D. Rowland; Robert W. Morris

[57] ABSTRACT

Power supply and control circuits are provided for driving a fluorescent lamp with a differential drive voltage from a low voltage DC power source. In one embodiment, the lamp is driven by a transformer having a primary and two independent secondary windings which produce the differential drive signal. A feedback signal indicative of the magnitude of current conducted by the lamp is produced from one of the secondary windings that is coupled to the control circuit so that the feedback signal is directly proportional to the energy required to light the lamp. In another embodiment, the lamp is driven by two independent transformers that are both driven by the control and drive circuit. The two secondary windings are each connected to one end of the lamp so that the lamp is driven by a differential drive signal. One of the secondary windings is also coupled to the control and drive circuit to provide a feedback signal indicative of the magnitude of current conducted by the lamp.

12 Claims, 2 Drawing Sheets

METHODS AND APPARATUS FOR OBTAINING FLOATING OUTPUT DRIVE TO FLUORESCENT LAMPS AND MINIMIZING INSTALLATION REQUIREMENTS

BACKGROUND OF THE INVENTION

This invention relates to fluorescent lamp power supplies. More particularly, this invention relates to cold cathode fluorescent lamp power supply and control circuits that enable the lamp to be regulated to shine with substantially reduced energy losses.

The use of fluorescent lamps continues to increase as systems requiring an efficient and broad-area source of visible light become essential for various consumer electronic devices. For example, the use of portable computers such as lap-top and notebook computers continues to explode. In portable computers, fluorescent lamps are used to back-light or side-light liquid crystal displays to improve the contrast or brightness of the display. Fluorescent lamps have also been used to illuminate automobile dashboards, and are being considered for use with battery-driven backup emergency EXIT lighting systems in commercial buildings.

Fluorescent lamps find use in these and other low-voltage applications because they are more efficient, and emit light over a broader area, than incandescent lamps. Particularly in applications requiring long battery life, such as in the case of portable computers, the increased efficiency of fluorescent lamps translates into extended battery life or reduced battery weight, or both.

In many portable device applications, however, extended battery life is often limited by energy losses, such as those due to parasitic energy paths. For example, fluorescent lamps are traditionally driven by single-ended signals, where one end of the lamp is coupled to a sinusoidal drive signal and the other end of the lamp is held at essentially ground potential. The parasitic energy loss is relatively high due to the high amplitude required to drive the lamp to fully illuminate it. This may necessitate the use of larger and heavier batteries or result in decreased battery life. Neither is desirable in portable computer applications.

A further disadvantage of some previous known fluorescent lamp power supply and control circuits is that all of the drive circuitry must be located in a single location that is relatively close to the lamp. This requires, for example, a relatively large panel to hold the liquid crystal display and lamp drive circuitry that is often used in portable computers.

In view of the foregoing, it would therefore be desirable to provide a power supply and control circuit for a cold cathode fluorescent lamp that enables the lamp's intensity to be driven and regulated at low-loss excitation levels.

It would also be desirable to provide a power supply and control circuit for a cold cathode fluorescent lamp that may be installed in portable devices such that less space is required and the devices, therefore, are more portable.

SUMMARY OF THE INVENTION

It is an object of this invention to provide a power supply and control circuit for a cold cathode fluorescent lamp that enables the lamp's intensity to be driven and regulated at low-loss excitation levels.

It is also an object of this invention to provide a power supply and control circuit for a cold cathode fluorescent lamp that may be installed in portable devices such that less space is required and the devices, therefore, are more portable.

In accordance with the present invention, there is provided a power supply and control circuit and method for driving a cold cathode fluorescent lamp from a low voltage D.C. source utilizing a differential drive signal. The differential drive signal is produced such that each end of the lamp is driven by a waveform that is preferably one-half the amplitude of a single-ended drive signal. The differential drive configuration results in parasitic paths that, due to the lower amplitude, draw less energy from the drive circuit.

In one embodiment, the differential drive signal is produced by a transformer secondary that consists of two independent windings. One of the windings is coupled between one end of the lamp and the control circuit. The other winding is coupled between the lamp and ground. The two independent secondary windings produce the differential lamp drive signal while also producing a feedback signal that comes directly from the secondary winding. The direct feedback signal enables the drive and control circuit to accurately and predictably drive the fluorescent lamp such that the lamp may be operated from full OFF to full ON and that the lamp's intensity is substantially constant from one end to the other.

In another embodiment, and in accordance with another aspect of the invention, the differential drive signal is produced by two separate transformers. In this embodiment, one transformer has its secondary coupled between the lamp and the feedback circuit. The second transformer, which has a primary winding coupled in parallel to the first transformer's primary winding, has a secondary winding coupled between the other end of the lamp and ground. In this manner, this embodiment achieves the benefits of the first embodiment described above, while providing the additional benefit that the two transformers may be located in different places.

The significance of locating the transformers in different locations is that each transformer may be physically located near to its lamp-load point, which minimizes parasitic losses due to the reduced wire length from the lamp to the secondary. Additionally, because the transformer is divided into two units, each unit may be smaller, thereby saving critical space in packaging considerations for the portable device in which the lamp drive and control circuit is installed.

Both embodiments include circuitry that enables the lamp's drive current to be varied by a user, thus allowing lamp intensity to be smoothly and continuously adjusted (without dead-spots or pop on) over a chosen range of intensities. This range of intensity variation can include, if desired, from substantially full OFF to full ON.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

Figure 1:
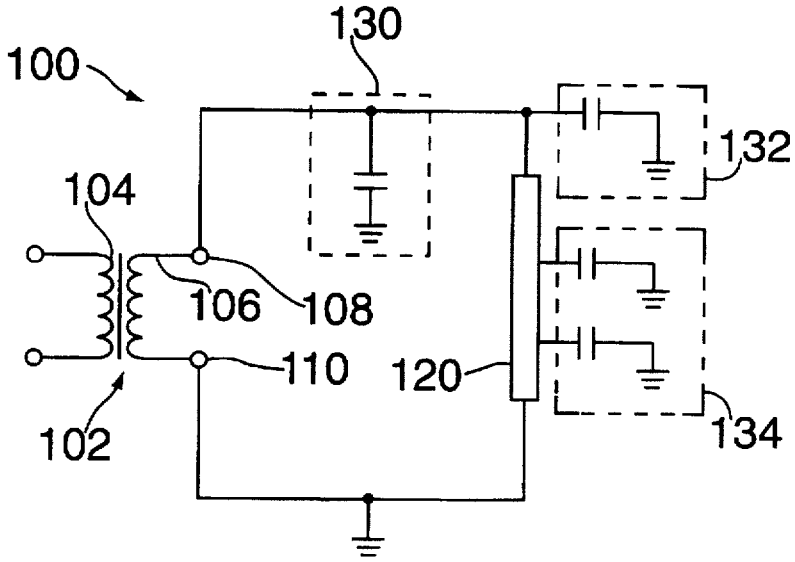
FIG. 1 PRIOR ART
FIG. 1 is a schematic diagram of a conventional single-ended fluorescent lamp power supply drive circuit.

FIG. 1 is a schematic diagram of a conventional single-ended fluorescent lamp power supply drive circuit 100. Drive circuit 100 includes a transformer 102 having a primary winding 104 and a secondary winding 106. A first end of fluorescent lamp 120 is connected to one end of secondary winding 106 via terminal 108. The second end of lamp 120 is connected to secondary winding 106 via terminal 110, which is also connected to ground. Single-ended drive circuit 100 excites lamp 120 by applying a high-voltage AC waveform to one end of the lamp (from terminal 108), while the other end is held at zero volts (i.e., ground).

Also shown in FIG. 1 are several instances of a capacitor coupled to ground, which represents parasitic capacitance. Each of these instances is shown in a dashed box to indicate that the capacitor is not an actual capacitor, but is instead a representation of the parasitic loss of energy due to the various parasitic paths. For example, parasitic losses 130 and 132 represent the energy lost in the wire that connects secondary winding 106 to the first end of lamp 120, while parasitic losses 134 represent the energy lost in the lamp itself. It is well known that the energy lost via parasitic paths is equal to:

$$E=\tfrac{1}{2}CV^2 \quad (1)$$

where C is the parasitic capacitance and V is the applied voltage.

Figure 2:
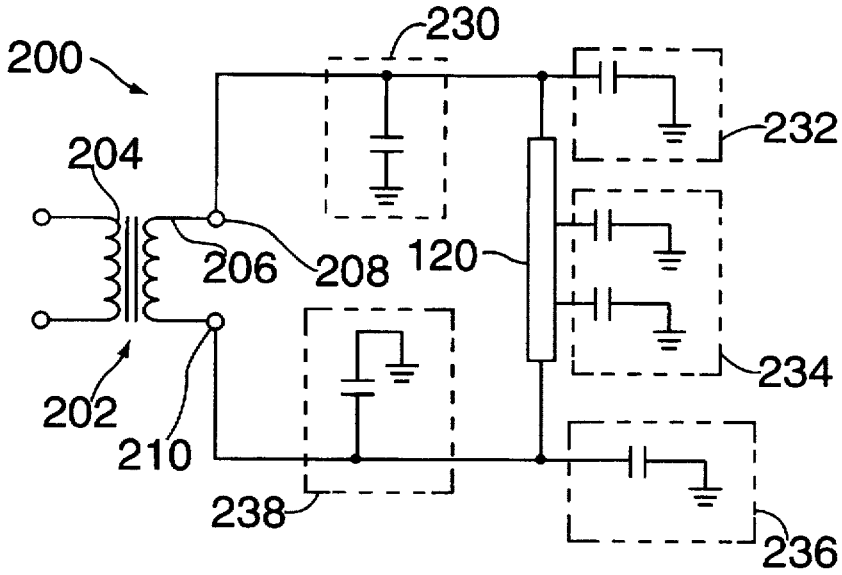
FIG. 2 PRIOR ART
FIG. 2 is a schematic diagram of a conventional differential fluorescent lamp power supply drive circuit.

FIG. 2 shows a conventional differential fluorescent lamp power supply and drive circuit 200 that reduces parasitic energy losses. Drive circuit 200 is substantially similar to drive circuit 100, except that both ends of lamp 120 are driven simultaneously. Transformer 202, which includes primary 204 and secondary 206, is connected to lamp 120 via terminals 208 and 210. Unlike secondary winding 106, secondary winding 206 is fully floating (i.e., not connected to ground—isolated).

Drive circuit 200 operates by driving both ends of lamp 120 with the same high voltage AC waveform, but the two ends are driven out of phase from each other. In this manner, lamp 120 is exposed to the same net high voltage amplitude swing, but the drive waveforms themselves are only ½ the amplitude of the single-ended waveform required in drive circuit 100. The reduced amplitude of the drive signals causes a reduction in the energy lost via parasitic paths 230, 232 and 234, as well as new paths 236 and 238 (even though additional paths 236 and 238 are established, the total energy lost in drive circuit 200 is still less than the energy lost by drive circuit 100 because "V" is smaller in drive circuit 200—see equation (1) above).

One deficiency of drive circuit 200, however, is that the fully floating secondary winding does not provide easily obtainable feedback signals to control the drive waveform without the introduction of errors. For example, one way in which a feedback signal may be obtained from the circuit of FIG. 2 is to measure the power required to drive the primary side of the transformer. This solution, however, is inadequate because it may result in errors or losses introduced into the feedback signal by the transformer between the primary and secondary windings.

Figure 3:
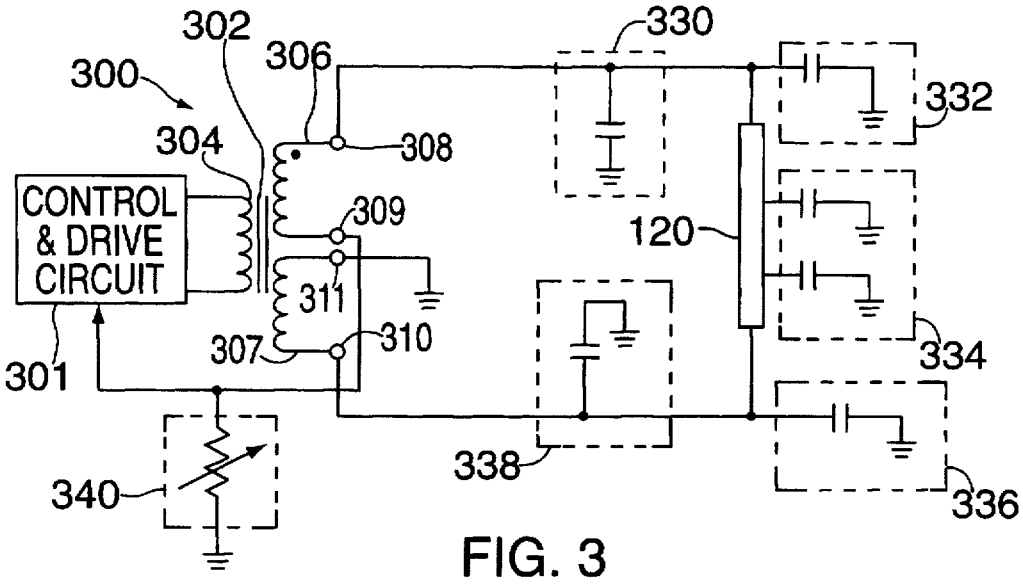
FIG. 3 is a schematic block diagram of a first embodiment of a differential fluorescent lamp power supply and control circuit constructed in accordance with the principles of the present invention.

The deficiencies of known fluorescent lamp drive circuits are overcome by the differential fluorescent lamp power supply and drive circuit 300 shown in FIG. 3. Drive circuit 300 includes a transformer 302 that consists of a primary winding 304 and two independent secondary windings 306 and 307, a variable resistor 340 (which is an optional component that may be used to adjust the intensity of lamp 120), and control & drive circuit 301. The secondary windings are coupled to lamp 120 such that secondary winding 306 has one terminal 308 coupled to one end of lamp 120 and a second terminal 309 coupled to control circuit 301 to provide a directly sensed feedback signal to control circuit 301. Secondary winding 307, on the other hand, has one terminal 310 coupled to the other end of lamp 120 and a second terminal 311 coupled to a ground terminal.

The two secondary windings 306 and 307, configured as described above, provide the desired differential lamp drive while also providing feedback signals that are directly related to the energy used to illuminate lamp 120 (because the feedback signal is taken from secondary winding 306 rather than the primary of transformer 302). Besides providing a more accurate and predictable feedback signal, the configuration shown in FIG. 3 also enables the feedback signal to be taken with relatively simple circuitry when compared to the circuitry required to monitor primary 304.

Control & drive circuit 301 provides a drive voltage to transformer 302 that produces a differential signal such that parasitic paths 330, 332, 334, 336 and 338 see a lower amplitude swing and thus, less energy is lost. Drive circuit 301 adjusts the drive voltage provided to transformer 302 based on the feedback signal from taken from secondary 306. Additionally, as described above, the feedback signal may be offset by optional variable resistor 340 (e.g., connected to a knob or slide that a user may adjust) such that the intensity of illumination of lamp 120 may be varied.

Figure 4:
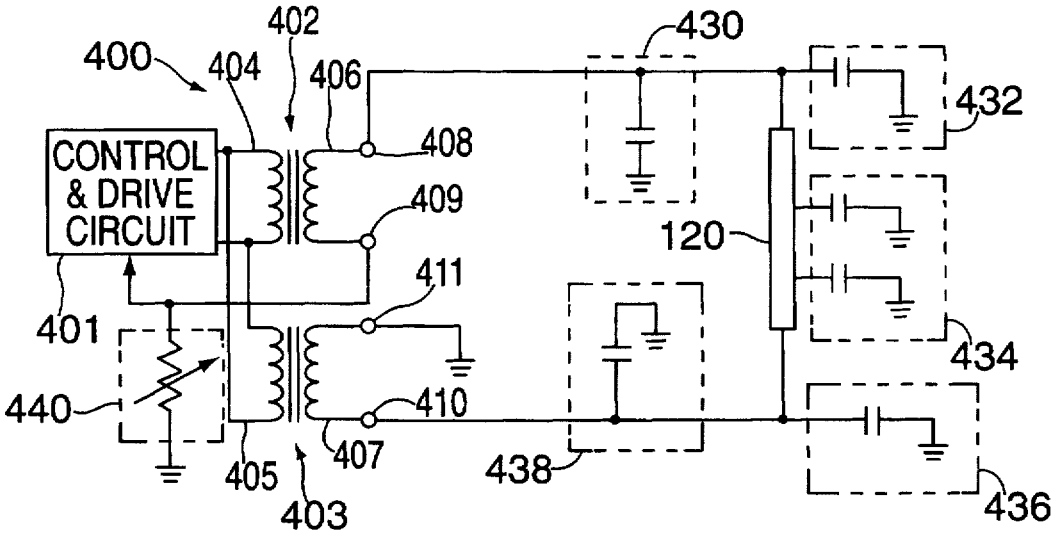
FIG. 4 is a schematic block diagram of a second embodiment of a differential fluorescent lamp power supply and control circuit constructed in accordance with the principles of the present invention.

Another embodiment of the present invention is shown in FIG. 4 in differential fluorescent lamp power supply and drive circuit 400. Differential drive circuit 400 is somewhat similar to differential drive circuit 300 described above with respect to FIG. 3, in that both circuits provide a differential drive signal to lamp 120 through two secondary windings. Differential drive circuit 400 differs from drive circuit 300 in that control & drive circuit 401 drives transformers 402 and 403, rather than driving a single transformer. Transformer 402, which includes primary winding 404 and secondary winding 406, is coupled to one end of lamp 120 via terminal 408. Terminal 409 of secondary 406 is coupled to drive circuit 401 to provide a feedback signal that is directly measured from the energy required to illuminate lamp 120 (terminal 409 may also be coupled to optional variable resistor 440, which operates in the same manner as resistor 330 described above).

Transformer 403, which includes primary 405 and secondary 407, is coupled to the other end of lamp 120 at terminal 410, and is also coupled to ground terminal 411. Primary winding 405 is coupled to control & drive circuit 401 such that transformer 403 provides the second half of the differential drive signal to lamp 120. Thus, as described above, the energy lost through parasitic paths 430, 432, 434, 436 and 438 is significantly reduced while lamp 120 is illuminated by an accurate and reliable signal.

Differential drive circuit 400 provides additional advantages over drive circuit 300 because of the use of two separate transformers. Each of transformers 402 and 403 may be constructed to be significantly smaller than single transformer 302, and as a result of their smaller size, may be physically located closer to the lamp load-points which further minimizes the parasitic losses in the lead wire between the transformers and lamp 120 (as previously described, one common application of fluorescent lamps is in laptop computers, where it is desirable for the shell (or lid) of the laptop to be as thin as practicable—often, in single transformer installations, the relatively large transformer is located in the base instead of the lid). The use of two transformers instead of one, therefore, enables the PC designer to install the transformers in the shell in close proximity to the lamps (i.e., a dual transformer installation reduces the size requirements, in at least one dimension, of the space needed within the shell to install the transformers).

Persons skilled in the art will thus appreciate that the present invention can be practiced by other than the described embodiments, which are presented for purposes of illustration and not of limitation, and the present invention is limited only by the claims which follow.

What is claimed is:

1. A circuit for operating a fluorescent lamp from a source of DC power, the circuit comprising:

a control and drive circuit that provides drive voltage sufficient to cause the fluorescent lamp to emit light;

a transformer primary winding coupled to the control and drive circuit to receive the drive voltage;

a first secondary transformer winding coupled to the primary winding, to one end of the lamp, and also coupled to the control and drive circuit to provide a feedback signal to the control and drive circuit that is directly proportional to the energy required to illuminate the lamp; and a second secondary transformer winding coupled to the primary winding and to the other end of the lamp such that the primary winding drives the first and second secondary windings to produce a differential drive signal that drives that lamp.

2. The circuit of claim 1, further comprising a circuit for adjusting the intensity with which the lamp is illuminated.

3. The circuit of claim 2, wherein the lamp adjustment circuit comprises a variable resistor coupled to the feedback signal provided by the first secondary winding.

4. A circuit for operating a fluorescent lamp from a source of DC power, the circuit comprising:

a control and drive circuit that provides drive voltage sufficient to cause the fluorescent lamp to emit light;

a first transformer primary winding coupled to the control and drive circuit to receive the drive voltage;

a first transformer secondary winding coupled to the first primary winding, to one end of the lamp, and also coupled to the control and drive circuit to provide a feedback signal to the control and drive circuit that is directly proportional to the energy required to illuminate the lamp;

a second transformer primary winding coupled to the control and drive circuit to receive the drive voltage; and a second transformer secondary winding coupled to the second primary winding and to the other end of the lamp such that the first primary winding drive the first secondary winding and the second primary drives the second secondary winding such that a differential drive signal is produced that drives that lamp.

5. The circuit of claim 4, further comprising a circuit for adjusting the intensity with which the lamp is illuminated.

6. The circuit of claim 5, wherein the lamp adjustment circuit comprises a variable resistor coupled to the feedback signal provided by the first secondary winding.

7. A method of illuminating a fluorescent lamp from a source of DC power, the method comprising the steps of:

controlling a drive circuit that converts the DC power to an AC drive voltage;

driving a transformer primary winding with the AC drive voltage; and coupling the transformer primary winding to first and second transformer secondary windings, the first secondary winding being connected to one end of the lamp and to the drive circuit such that a feedback signal that is directly proportional to the energy used to illuminate the lamp to provided to the drive circuit, the second secondary winding being connected to the other end of the lamp such that the first and second secondary windings drive the lamp with a differential drive signal that causes the lamp to lite.

8. The method of claim 7, further comprising the step of:

adjusting the intensity that the lamp is illuminated by varying the feedback signal provided by the first secondary winding.

9. The method of claim 8, wherein the step of adjusting comprises the step of:

varying the setting of a variable resistor that is coupled to a line carrying the feedback signal to the drive circuit.

10. A method of illuminating a fluorescent lamp from a source of DC power, the method comprising the steps of:

controlling a drive circuit that converts the DC power to an AC drive voltage;

driving a first transformer primary winding with the AC drive voltage;

driving a second transformer primary winding with the AC drive voltage; and coupling the first transformer primary winding to a first transformer secondary winding that is connected to one end of the lamp and to the drive circuit such that a feedback signal that is directly proportional to the energy used to illuminate the lamp to provided to the drive circuit; and coupling the second transformer primary winding to a second transformer secondary winding that is connected to the other end of the lamp such that the first and second secondary windings drive the lamp with a differential drive signal that causes the lamp to emit light.

11. The method of claim 10, further comprising the step of:

adjusting the intensity that the lamp is illuminated by varying the feedback signal provided by the first secondary winding.

12. The method of claim 11, wherein the step of adjusting comprises the step of:

varying the setting of a variable resistor that is coupled to a line carrying the feedback signal to the drive circuit.

* * * * *